United States Patent [19]

Heilmann et al.

[11] Patent Number: 4,869,470

[45] Date of Patent: Sep. 26, 1989

[54] VACUUM FURNACE FOR HEAT TREATMENT OF METALLIC WORKPIECES

[75] Inventors: Paul Heilmann, Kahl/M; Fritz Kalbfleisch, Gruendau; Friedrich Preisser, Buedingen; Rolf Schuster, Erwin Keumeuller Hanau, all of Fed. Rep. of Germany

[73] Assignee: Degussa Aktiengesellschaft, Frankfurt, Fed. Rep. of Germany

[21] Appl. No.: 260,771

[22] Filed: Oct. 21, 1988

[30] Foreign Application Priority Data

Oct. 28, 1987 [DE] Fed. Rep. of Germany ..... 3736502

[51] Int. Cl.[4] ..... C21D 9/00

[52] U.S. Cl. ..... 266/250

[58] Field of Search ..... 266/250, 249, 251, 259

[56] References Cited

U.S. PATENT DOCUMENTS 1,617,056 2/1927 Kenworthy ..... 266/259

*Primary Examiner*—Christopher W. Brody

*Attorney, Agent, or Firm*—Beveridge, DeGrandi & Weilacher

[57] ABSTRACT

A vacuum furnace for heat treatment of metallic workpieces wherein the heat conductors are formed as conduits fitted with bore holes and connected by electrical insulators to coolant gas distributor.

5 Claims, 2 Drawing Sheets

VACUUM FURNACE FOR HEAT TREATMENT OF METALLIC WORKPIECES

INTRODUCTION AND BACKGROUND

The present invention relates to a vacuum furnace for the heat treatment of metallic workpieces having a cylindrical pressure shell in which are disposed a charge chamber surrounded by axially aligned heating conductors and provided with a thermal insulation and a gas-cooling device, with which a coolant gas can be passed through nozzles through the charge chamber and through a heat exchanger. Such vacuum furnaces are particularly used for the hardening of all kinds of tools and structural parts of many different steel grades. In some cases they can also be used for other heat treatments, e.g., annealing and soldering.

Vacuum furnaces in general are described in West German Patents Nos. 2,839,807 and 2,844,843. They include as essential components a cylindrical pressure shell in which is located a charge chamber bounded by thermal insulation walls and heated with heating elements, and a gas-cooling device. The tools and structural parts are heated under vacuum in the charge chamber to the austenitizing temperature and, for quenching, a cooled inert gas is circulated in the furnace under pressure. In the process, the coolant gas flows at high velocity onto the hot charge, removes heat energy therefrom and is passed through a heat exchanger, where it is cooled and returned to the charge chamber. According to West German Patent No. 2,839,807, the coolant gas is injected into the charge chamber through nozzles, which are attached to separate axially aligned gas-inlet conduits. One disadvantage of this construction is the high material and fabrication costs for the gas-inlet conduits in the furnace. Conduits and nozzles must consist of refractory material. The fans used in West German Patent No. 2,844,843 have the drawback that the coolant gas flows to a considerable extent only along the hot charge surface and does not penetrate into the charge interior.

West German Laid-open Application 1,919,493 teaches how to accelerate the heating of the charge in the temperature range between room temperature and approximately 750° C. by circulating an inert gas into the furnace by means of a fan and thereby to generate air in addition to the radiation. Here, too, however, there is no optimum heat transfer between heating conductors and charge.

SUMMARY OF THE INVENTION

Accordingly, it is an object of the present invention to provide a vacuum furnace for the heat treatment of metallic workpieces having a cylindrical pressure shell in which are disposed a charge chamber surrounded by axially aligned heating conductors and provided with a thermal insulation, and a gas-cooling device with which a coolant gas can be passed through nozzles through the charge chamber and through a heat exchanger. A feature of the vacuum furnace of the invention is to achieve with the simplest possible construction, the most rapid and uniform cooling possible of the heated charges, and which furnace could be heated rapidly as possible.

BRIEF DESCRIPTION OF DRAWINGS

The invention will be further understood with reference to the drawings, wherein:

FIG. 2 depicting the same in the cooling phase.

DETAILED DESCRIPTION OF INVENTION

According to the more detailed aspects of the invention, the construction of a vacuum furnace for the heat treatment of metallic workpieces has a cylindrical pressure shell in which is disposed a charge chamber surrounded by axially aligned heating conductors. It is also provided with a thermal insulation, as well as a gas-cooling device with which a coolant gas can be passed through nozzles into the charge chamber and through a heat exchanger. Because of the simple construction, the vacuum furnace of the invention provides rapid and uniform heating and cooling of the heated charges.

In a further detailed aspect of the invention, the heating conductors are constructed as conduits, provided with bores to the charge chamber, and connected by electrical insulators to a coolant-gas distributing device.

Preferably, the coolant-gas distributing device is provided with a fan which forces the coolant gas through the heating conduits and sucks it back from the charge chamber.

A further advantage is to provide the thermal insulator in the area of the coolant-gas distributor with a closable aperture, so that a heating-gas flow that bypasses the heat exchanger can be maintained in the furnace interior during the period in which the charges are heating up.

In the case of expensive coolant gases, it is also advantageous to provide the furnace with a recovery system for the coolant gas.

Figure 1:
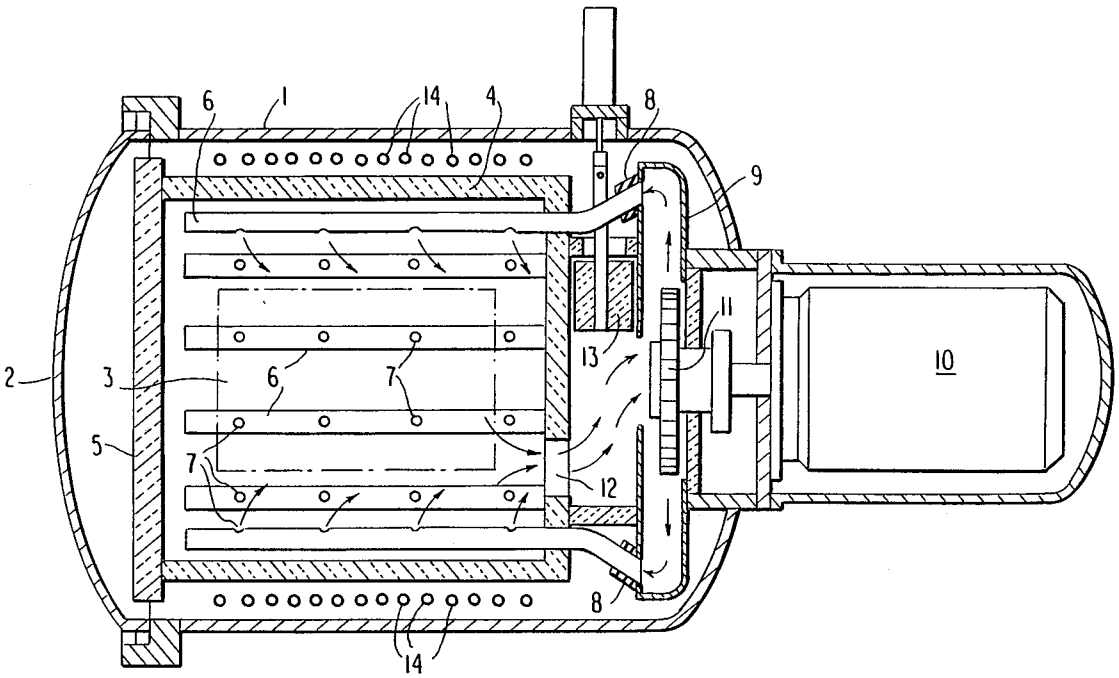
FIGS. 1 and 2 schematically show longitudinal sections through a practical embodiment of a vacuum furnace incorporating the invention, FIG. 1 illustrating the furnace in the heating phase up to approximately 750° C.

Referring to the drawings, FIG. 1 shows the furnace formed of a cylindrical pressure shell (1), one end face of which is formed as a door (2), through which the furnace can be loaded and unloaded. The charge chamber (3) is bounded on the outside by a thermal insulation (4) in the form of a cylindrical conduit, which consists of a thermally insulating material and is provided at the end faces with appropriate walls, at least one (5) of which is movable. This thermal insulation (4) prevents radiation in the charge chamber (3) to the outside, so that only minor energy losses occur. Inside the thermal insulation (4), the electrical heating conductors (6), which are formed as heating conduits and are provided with bore holes (7) communicating to the charge chamber (3), are disposed axially in a circle in the charge chamber (3). These heating conduits (6) have, for example, a wall thickness of 1 to 3 mm and an inside width of 40 to 150 mm. The diameter ofo the bore holes (7) is dimensioned such that the sum of the areas of the boxes in one heating conduit corresponds to the area of the inside width. The heating conduits (6) are fixed by electrical insulators (8) to the coolant-gas distributing device (9) which, together with the drive motor (10) and the fan (11), is installed in the pressure shell on the side opposite the door (2). The wall of the thermal insulation (4) adjacent to the coolant-gas distributing device (9) is provided with an aperture (12), which can be closed and opened with a slide gate (13). The water-cooled heat-exchanger conduits (14) are installed between the pressure shell (1) and the thermal insulation (4).

After the charge chamber (3) has been loaded with, for example, workpieces or tools, it is washed with an inert gas in order to clear the system and heated. The slide gate (13) opens the aperture (12) in the thermal insulation (FIG. 1), so that the inert gas can be forced by the fan (11) into the heating conduits (6), from which it enters, through the bore holes (7) which are distributed along the length of the heating conduits, the charge chamber (3) and is returned to the fan (11) through the aperture (12) in the thermal insulation. Since the inert gas is passed through the heating conduits (6), it very rapidly assumes its temperature, resulting in a rapid and homogeneous heating of the charge by the hot gas in the dark-radiation zone. Because of the effective traverse of the charge by the hot gas, the former is heated evenly in the interior as well. This heating process under protective gas is conducted up to approximately 750° C. In hardening treatments in which heating up to approximately 1300° C. is necessary, the inert gas is then removed from the furnace and the further heating occurs solely by heat radiation which is very effective in this elevated temperature range.

Figure 2:
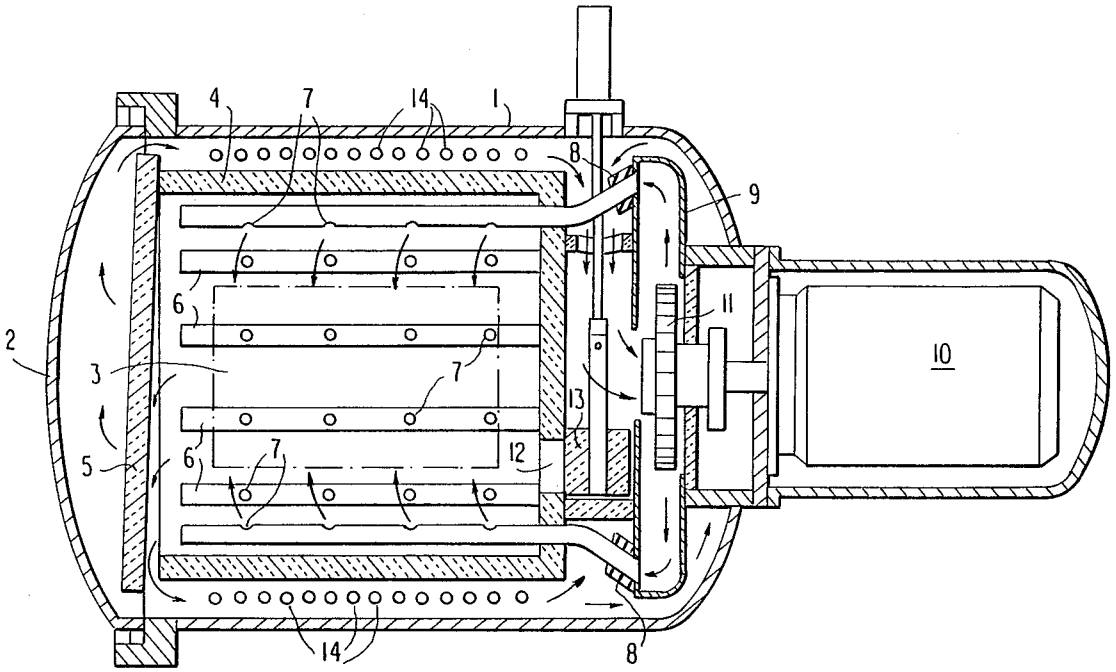

To quench the heated charge, the furnace is washed with cold inert gas at above-atmospheric pressure while the aperture (12) is closed. In this way, the wall (5) of the thermal insulation (4) is disengaged from the cylindrical conduit, so that a gap is formed and the charge chamber (3) is in communication with the space between the pressure shell (1) and the thermal insulation (4) (FIG. 2). The coolant gas is forced at high velocity by the fan (11) through the cooled heating conduits (6) into the charge chamber (3), from where it flows back through the heat exchanger conduits (14) into the coolant-gas distributing device (9) and is recirculated. When using appropriate inert gases in conjuction with high gas pressures and gas velocities, quenching intensities comparable with those attainable in oil-quenching baths are achieved with the vacuum furnace embodying the invention. Consequently, steel types other than heretofore can also be quenched and hardened with a gas-cooling system.

Preferably, the heating conduits (6), which function at the same time as gas-supply conduits, consist of carbon-fiber-reinforced carbon. The electrically conducting cross section of the heating conduits, which determines the heat generation, and the inside width of the heating conduits, which determines the gas volume flow, must be matched to each other. The combination of heating element and gas-supply conduits results in a significant simplification of the production technology when manufacturing these furnaces.

The materials of construction of all elements of the furnace of this invention, including the insulation, can be conventional materials known in this art.

If an expensive inert gas is used for quenching, it is advantageous to recover the same. For this purpose, the coolant gas, after completion of the quenching process, is pumped out of the furnace interior with a compressor and delivered to a high-pressure accumulator, where it is kept available for other applications.

Further modifications and variations will be apparent to those skilled in the art from the foregoing and are intended to be encompassed by the appended claims.

We claim:

1. A vacuum furnace for the heat treatment of metallic workpieces comprising a cylindrical pressure shell in which is disposed a charge chamber surrounded by a plurality of axially aligned heating conductors and provided with thermal insulating means, and a gas-coolant device, with which a coolant gas can be passed through nozzles through the charge chamber and through a heat exchanger, wherein the heating conductors (6) are formed as conduits, are provided with a plurality of bore holes (7) communicating to the charge chamber and are connected by electrical insulators (8) to a coolant-gas distributor (9).

2. The vacuum furnace as set forth in claim 1, wherein the coolant-gas distributor (9) is provided with a fan (11).

3. The vacuum furnace as set forth in claim 1, wherein the thermal insulation means (4) is a wall provided in the area of the coolant-gas distributor (9) with a closable aperture (12).

4. The vacuum furnace as set forth in claim 1, wherein a recovery system for the coolant gas is present.

5. The vacuum furnace as set forth in claim 1, wherein the bore holes have a diameter such that sum of the area of the bore holes in a single heating conduit corresponds to the inside width.

* * * * *